US010570838B2

(12) United States Patent
Miyamura et al.

(10) Patent No.: US 10,570,838 B2
(45) Date of Patent: Feb. 25, 2020

(54) SENSING SYSTEM LAYOUT STRUCTURE OF INTERNAL COMBUSTION ENGINE

(71) Applicant: HONDA MOTOR CO., LTD., Tokyo (JP)

(72) Inventors: Takuya Miyamura, Wako (JP); Hodaka Mukohara, Wako (JP); Tomokazu Kobayashi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/895,093

(22) Filed: Feb. 13, 2018

(65) Prior Publication Data

US 2018/0283300 A1 Oct. 4, 2018

(30) Foreign Application Priority Data

Mar. 30, 2017 (JP) ..... 2017-069172

(51) Int. Cl.

| | |
|---|---|
| ***F02D 41/00*** | (2006.01) |
| ***F02B 75/22*** | (2006.01) |
| ***F02B 77/08*** | (2006.01) |
| *F02B 75/18* | (2006.01) |

(52) U.S. Cl.

CPC ..... *F02D 41/0097* (2013.01); *F02B 75/22* (2013.01); *F02B 77/087* (2013.01); *F02B 2075/1808* (2013.01)

(58) Field of Classification Search

CPC ..... F02D 41/0097; F02D 35/00; F02B 75/22; F02B 67/06; F02B 2075/1808; F01L 1/46; F01L 1/047; F01L 1/053

See application file for complete search history.

(56) References Cited

U.S. PATENT DOCUMENTS 4,718,396 A * 1/1988 Shimada ..... F02B 77/087 123/476
7,624,712 B1 * 12/2009 Pursifull ..... F02D 41/009 123/179.16

(Continued)

FOREIGN PATENT DOCUMENTS

| | | |
|---|---|---|
| DE | 102013214303 A1 | 1/2015 |
| JP | 2006-348914 | 12/2006 |
| JP | 2010-229880 A | 10/2010 |

OTHER PUBLICATIONS

Japanese Office Action with English translation dated Oct. 30, 2018, 7 pages.

(Continued)

*Primary Examiner* — Grant Moubry
(74) *Attorney, Agent, or Firm* — Rankin, Hill & Clark LLP

(57) ABSTRACT

To provide sensing system layout structure of an internal combustion engine that enables increasing a degree of freedom in laying out a sensing system. In sensing system layout structure of an internal combustion engine provided with a sensing system for sensing rotation of a camshaft, the internal combustion engine is provided with a driving shaft rotated in synchronization with the camshaft, the sensing system is provided with a driving shaft rotation detecting sensor arranged opposite to a rotated portion on a side of the driving shaft, and rotation of the driving shaft is sensed by the driving shaft rotation detecting sensor.

6 Claims, 5 Drawing Sheets

(56) References Cited

U.S. PATENT DOCUMENTS

| | | | | |
|---|---|---|---|---|
| 7,766,708 | B2 * | 8/2010 | Akuzawa | B63H 20/20 440/1 |
| 8,656,762 | B2 * | 2/2014 | Hoetzel | F02D 41/0097 73/114.26 |
| 9,568,310 | B2 * | 2/2017 | Stuckert | G01B 21/16 |
| 2008/0215225 | A1 * | 9/2008 | Nakamura | B60W 10/06 701/102 |
| 2009/0255510 | A1 * | 10/2009 | Mashiki | F01L 1/352 123/347 |
| 2009/0276145 | A1 * | 11/2009 | Schafer | F01L 1/024 701/105 |
| 2015/0369195 | A1 * | 12/2015 | Wang | F01L 13/0015 701/113 |
| 2017/0122139 | A1 * | 5/2017 | Kaneko | F02D 41/08 |

OTHER PUBLICATIONS

German Office Action dated Nov. 14, 2018 with English Translation, 26 pages.

* cited by examiner

SENSING SYSTEM LAYOUT STRUCTURE OF INTERNAL COMBUSTION ENGINE

INCORPORATION BY REFERENCE

The present application claims priority under 35 U.S.C. § 119 to Japanese Patent Application No. 2017-069172 filed on Mar. 30, 2017. The content of the application is incorporated herein by reference in its entirety.

TECHNICAL FIELD

The present invention relates to sensing system layout structure of an internal combustion engine.

BACKGROUND ART

Conventionally, there has been known an internal combustion engine in which a convex sensing element is formed on a cam of a camshaft and a cam nose is sensed by a sensor arranged in a cylinder head cover (for example, refer to a patent literature 1).

CITATION LIST

Patent Literature

[Patent Literature 1] JP-A No. 2006-348914

SUMMARY OF INVENTION

Technical Problem

In the patent literature 1, when a sensor is arranged in a head cover, it is difficult to secure space in the head cover and a degree of freedom in laying out the sensor is limited.

An object of the present invention is to provide sensing system layout structure of an internal combustion engine that enables increasing a degree of freedom in laying out a sensing system.

Solution to Problem

To address the above-mentioned problem, an aspect of the present invention provides sensing system layout structure of an internal combustion engine including a sensing system (169) for sensing rotation of a camshaft (102). The internal combustion engine (10) has a shaft member (63) rotated in synchronization with the camshaft (102), the sensing system (169) is provided with a sensor body (165) arranged opposite to a rotated portion on a side of the shaft member (63) and the rotation of the shaft member (63) is sensed by the sensor body (165).

In the above-mentioned aspect of the invention, the shaft member (63) may be also rotated at equal velocity to the camshaft (102).

Besides, in the above-mentioned aspect of the invention, the internal combustion engine (10) is a V type provided with a one-side cylinder (12) and an other-side cylinder (13), a V shape of the internal combustion engine (10) is formed by the one-side cylinder (12) and the other-side cylinder (13), and the sensor body (165) may be also arranged between respective cylinder axes (31*b*, 41*b*) of the one-side cylinder (12) and the other-side cylinder (13) in an axial direction view of a crankshaft (16).

Moreover, in the above-mentioned aspect of the invention, the sensor body (165) may be also arranged in such a manner that the sensor body (165) is overlapped with the one-side cylinder (12) in the axial direction view of the crankshaft (16).

In addition, in the above-mentioned aspect of the invention, a sensed member (164) sensed by the sensor body (165) may be also attached to the shaft member (63).

Advantageous Effects of Invention

As the internal combustion engine according to the aspect of the present invention is provided with the shaft member rotated in synchronization with the camshaft, the sensing system is provided with the sensor body arranged opposite to the rotated portion on the side of the shaft member and the rotation of the shaft member is sensed by the sensor body, the sensing system is not required to be arranged in vicinity of the camshaft and a degree of freedom in laying out the sensing system can be increased.

In the above-mentioned aspect of the invention, as the shaft member is rotated at equal velocity to the camshaft, a program for operating angular velocity and others of the camshaft is not made intricate and a cost can be inhibited.

Further, in the above-mentioned aspect of the invention, as the internal combustion engine is the V type provided with the one-side cylinder and the other-side cylinder, the V shape of the internal combustion engine is formed by the one-side cylinder and the other-side cylinder, and the sensor body is arranged between the respective cylinder axes of the one-side cylinder and the other-side cylinder in the axial direction view of the crankshaft, space between the respective cylinder axes of the one-side cylinder and the other-side cylinder in the axial direction view of the crankshaft can be effectively utilized.

Furthermore, in the above-mentioned aspect of the invention, as the sensor body is arranged in such a manner that the sensor body is overlapped with the one-side cylinder in the axial direction view of the crankshaft, the sensor body can be arranged close to the one-side cylinder and the sensor body can be compactly arranged.

Furthermore, in the above-mentioned aspect of the invention, as the sensed member sensed by the sensor body is attached to the shaft member, a function except detection can be given to the shaft member by using the sensed member. Furthermore, respective degrees of freedom in design of the sensed member and the shaft member can be increased by separately providing the shaft member and the sensed member, and the sensed member and the shaft member can be made a simple shape.

DESCRIPTION OF EMBODIMENTS

One embodiment of the present invention will be described with reference to the drawings below. Unless otherwise stated in the description, directions such as a longitudinal direction, a lateral direction and a vertical direction shall be the same as directions in a vehicle body. Besides, a reference sign FR shown in each drawing denotes the front of the vehicle body, a reference sign UP denotes the upside of the vehicle body, and a reference sign LH denotes the left of the vehicle body.

Figure 1:
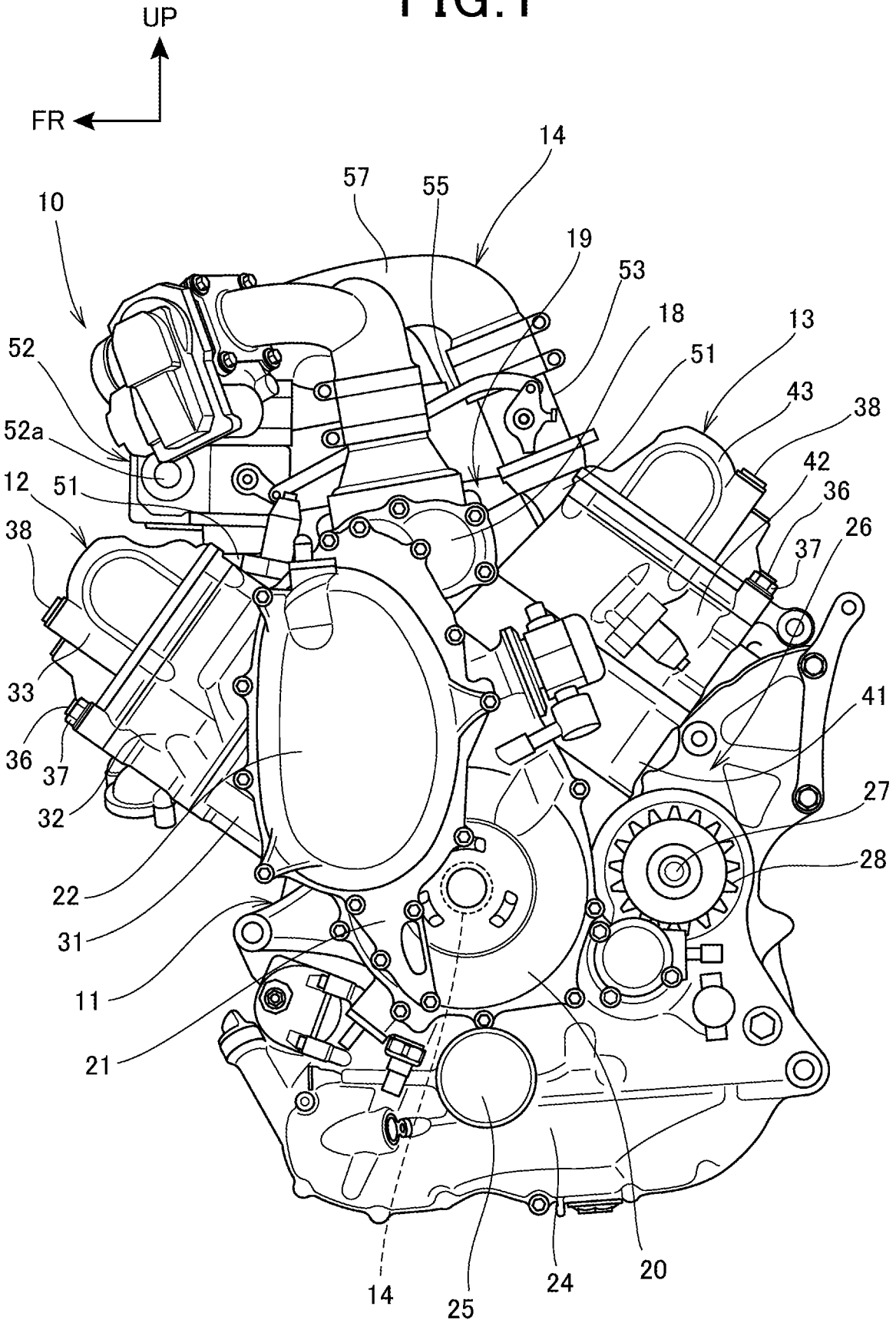
FIG. 1 is a left side view showing an internal combustion engine according to the present invention.

FIG. 1 is a left side view showing an internal combustion engine 10 according to the present invention.

The internal combustion engine 10 is a V type mounted in a motorcycle and the internal combustion engine 10 is provided with a crankcase 11, a front cylinder 12 and a rear cylinder 13. The front cylinder 12 is extended diagonally upward toward the front of a vehicle from an upper portion of the crankcase 11. The rear cylinder 13 is extended diagonally upward toward the rear of the vehicle from the upper portion of the crankcase 11. The front cylinder 12 and the rear cylinder 13 form a V shape.

Besides, in the internal combustion engine 10, an intake system 14 is connected to the rear of the front cylinder 12 and the front of the rear cylinder 13, and an exhaust system (not shown) is connected to the front of the front cylinder 12 and the rear of the rear cylinder 13.

The intake system 14 is provided with a supercharger 18 driven by power of a crankshaft 16 housed in the crankcase 11. The supercharger 18 is arranged in space 19 made between a back of the front cylinder 12 and a front of the rear cylinder 13.

An AC generator cover 20 covering the side of an AC generator (ACG) provided around the crankshaft 16 is attached to a left side of the crankcase 11. Further, a side cover 21 is attached to the ACG cover 20. Inside the side cover 21, a supercharger driving mechanism (not shown) is housed. The supercharger driving mechanism transmits power to the supercharger 18 from the crankshaft 16 so as to drive the supercharger 18.

A breather cover 22 forming a breather (not shown) for passing blowby gas in the crankcase 11 is attached to the upside of the side cover 21. In the breather, liquid oil is separated from the blowby gas.

An oil pan 24 for accumulating oil is set in a lower portion of the crankcase 11. An oil filter 25 is attached to a side of the oil pan 24.

A transmission 26 is integrated with the rear of the crankcase 11. The transmission 26 is provided with an output shaft 27 protruded sideways from a side of the crankcase 11 and a drive sprocket 28 attached to the output shaft 27. The drive sprocket 28 is coupled to a driven sprocket provided on the rear wheel side of the motorcycle via a chain. Hereby, driving force is transmitted from the transmission 26 to a rear wheel.

The front cylinder 12 is provided with a front cylinder block 31, a front cylinder head 32 and a front head cover 33 respectively set on/over the crankcase 11 in the order. The front cylinder block 31 and the front cylinder head 32 are fastened to the crankcase 11 by plural stud bolts 36 and plural nuts 37. The front head cover 33 is fastened to the front cylinder head 32 by plural bolts 38.

The rear cylinder 13 is provided with a rear cylinder block 41, a rear cylinder head 42 and a rear head cover 43 respectively set on/over the crankcase 11 in the order. The rear cylinder block 41 and the rear cylinder head 42 are fastened to the crankcase 11 by plural stud bolts 36 and plural nuts 37. The rear head cover 33 is fastened to the rear cylinder head 42 by plural bolts 38.

The intake system 14 is provided with intake pipes 51, a throttle device 52 for TBW, a throttle device 53, a connecting tube 57 and the supercharger 18.

The intake pipe 51 is provided to the front cylinder head 32 and the throttle device 52 for TBW is connected to the intake pipe 51. The throttle device 52 for TBW is provided with an electric motor 52*a* and a throttle valve (not shown) driven by the electric motor 52*a*, and the throttle device 52 for TBW is a part configuring the following TBW.

The throttle-by-wire system (TBW) denotes a system that instructs a sensor to sense a turn of a throttle grip provided to the motorcycle, transmits a turn detection signal to the electric motor 52*a* via a conductor and instructs the electric motor 52*a* to open/close the throttle valve.

The intake pipe 51 is provided to the rear cylinder head 42 and the throttle device 53 is connected to the intake pipe 51. The throttle device 53 is provided with a throttle valve (not shown) opened/closed in interlock with the throttle valve of the throttle device 52 for TBW. Both throttle valves are coupled via a rod 55.

Each two-forked end of the connecting tube 57 is connected to the throttle device 52 for TBW and the throttle device 53. Besides, the supercharger 18 is connected to an end provided to an intermediate portion of the connecting tube 57.

Moreover, an air cleaner is connected to the supercharger 18 via a connecting tube (not shown) on the upstream side.

Figure 2:
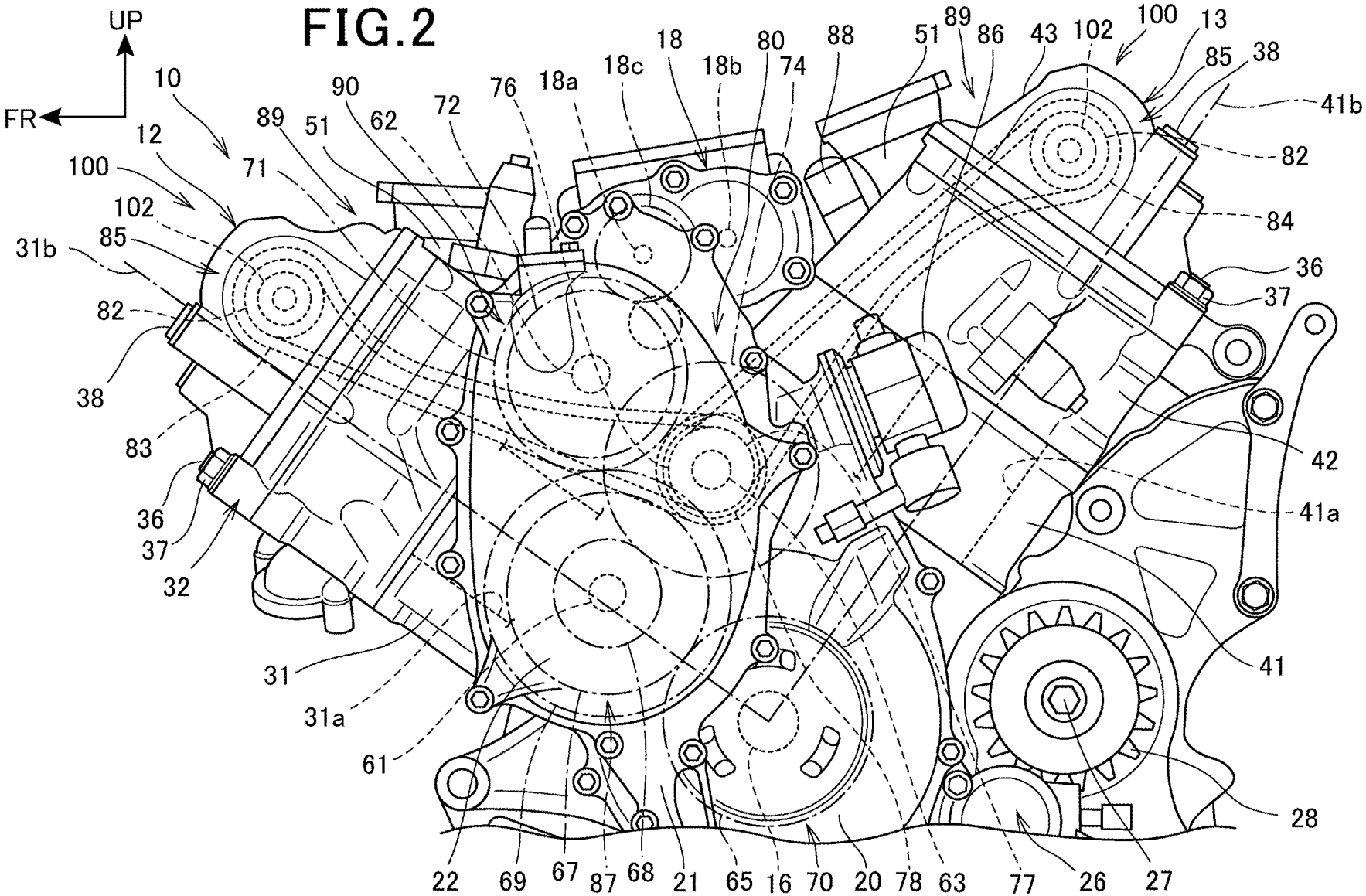
FIG. 2 is an enlarged view showing a main part shown in FIG. 1.

FIG. 2 is an enlarged view of a main part shown in FIG. 1.

The front cylinder block 31 and the rear cylinder block 41 are provided with cylinder bores 31*a*, 41*a* inside each block 31, 41 and a piston is movably inserted into each cylinder bore 31*a*, 41*a*. An angle made by cylinder axes 31*b*, 41*b* passing each center of the cylinder bores 31*a*, 41*a* is 90°.

In the crankcase 11, a pair of intermediate shafts 61, 62 located inside the breather cover 22 in a vehicle width direction and a driving shaft 63 located on the upside of the crankshaft 16 are rotatably supported.

The crankshaft 16 is provided with a main driving gear 65.

The one intermediate shaft 61 is provided with a first intermediate gear 67 engaged with the main driving gear 65, a second intermediate gear 68 having a smaller diameter than the first intermediate gear 67 and a third intermediate gear 69 having a larger diameter than the first intermediate gear 67.

The other intermediate shaft 62 is provided with a fourth intermediate gear 71 engaged with the third intermediate gear 69 and a fifth intermediate gear 72 having a smaller diameter than the fourth intermediate gear 71.

The driving shaft 63 is provided with a sub-driving gear 74 engaged with the second intermediate gear 68, a pair of a first timing sprocket 76 and a second timing sprocket 77, and a cam 78.

The front cylinder head 32 and the rear cylinder head 42 rotatably support each camshaft 102 and each camshaft 102 of the front cylinder head 32 and the rear cylinder head 42 is provided with a cam sprocket 82.

A first timing chain 83 is wound onto the first timing sprocket 76 and the cam sprocket 82 of the front cylinder head 32 and a second timing chain 84 is wound onto the second timing sprocket 77 and the cam sprocket 82 of the rear cylinder head 42.

As the first timing sprocket 76, the second timing sprocket 77 and the cam sprockets 82 have the same number of teeth, a number of revolutions of the driving shaft 63 and the pair of camshafts 102 is the same.

The main driving gear 65, the first intermediate gear 67, the second intermediate gear 68 and the sub-driving gear 74 configure a deceleration mechanism 87 that reduces a rotation of the crankshaft 16 and transmits the reduced rotation to the driving shaft 63.

When the rotation of the crankshaft 16 is transmitted to the driving shaft 63 via the deceleration mechanism 87, the number of revolutions is reduced to ½. That is, a number of revolutions of the camshaft 102 is equivalent to ½ of a number of revolutions of the crankshaft 16.

For example, when the number of teeth of the camshaft 102 is set to double of each number of teeth of the first timing sprocket 76 and the second timing sprocket 77 so as to acquire the number of revolutions of the camshaft 102, an outer diameter of the cam sprocket 82 becomes larger than each outer diameter of the first timing sprocket 76 and the second timing sprocket 77. Hereby, the front cylinder 12 and the rear cylinder 13 are large-sized.

In the meantime, in this embodiment, the outer diameter of the cam sprocket 82 is made the same as each outer diameter of the first timing sprocket 76 and the second timing sprocket 77. Hereby, the cam sprocket 82 can be made a small diameter, and the front cylinder 12 and the rear cylinder 13 can be miniaturized.

The supercharger 18 is provided with a pair of rotor shafts 18*a*, 18*b* respectively arranged in parallel and a rotor (not shown) is respectively attached to the rotor shafts 18*a*, 18*b*. The one rotor shaft 18*a* is provided with a rotor shaft gear 18*c* engaged with the fifth intermediate gear 72.

A high pressure fuel pump 86 operated utilizing power of the driving shaft 63 is attached to the rear of the ACG cover 20.

The high pressure fuel pump 86 is driven by turning the cam 78 provided to the driving shaft 63. Fuel made high pressure in the high pressure fuel pump 86 is injected into each combustion chamber of the front cylinder 12 and the rear cylinder 13 via each fuel injection valve 88 (only one fuel injection valve 88 is shown) provided to the front cylinder head 32 and the rear cylinder head 42.

The crankshaft 16, the main driving gear 65, the intermediate shaft 61, the first intermediate gear 67, the second intermediate gear 68 and the third intermediate gear 69 configure a main driving mechanism 70.

Besides, the driving shaft 63, the first timing sprocket 76, the second timing sprocket 77, the first timing chain 83, the second timing chain 84 and the pair of cam sprockets 82 configure a camshaft driving mechanism 80 that drives each camshaft 102 of the front cylinder 12 and the rear cylinder 13. The camshaft driving mechanism 80 is driven by the second intermediate gear 68 of the main driving mechanism 70 and the pair of camshafts 102 is driven by the camshaft driving mechanism 80. The second intermediate gear 68 may be also included in the camshaft driving mechanism 80.

The front cylinder head 32 and the rear cylinder head 42 are respectively provided with a rocker shaft, a rocker arm, a valve spring, an intake and exhaust valve and others. The camshaft 102 configures a valve train (valve system) 100 that opens/closes the intake and exhaust valve together with the rocker shaft, the rocker arm, the valve spring and others.

The camshaft driving mechanism 80 and the valve train 100 configure a valve driving mechanism 89 that drives the intake and exhaust valve.

Further, the intermediate shaft 62, the fourth intermediate gear 71 and the fifth intermediate gear 72 configure a supercharger driving mechanism 90. The supercharger driving mechanism 90 is driven by the third intermediate gear 69 of the main driving mechanism 70 and the supercharger 18 is driven by the supercharger driving mechanism 90. The third intermediate gear 69 may be also included in the supercharger driving mechanism 90.

As described above, as the driving shaft 63 is rotated at equal velocity to the camshaft 102, a program for operating angular velocity and others of the camshaft 102 is not complicated and a cost can be inhibited.

Besides, the internal combustion engine 10 is a V type provided with the front cylinder 12 as a one-side cylinder and the rear cylinder 13 as the other-side cylinder, a V shape of the internal combustion engine 10 is formed by the front cylinder 12 and the rear cylinder 13, and a driving shaft rotation detecting sensor 165 is arranged between the respective cylinder axes 31*b*, 41*b* of the front cylinder 12 and the rear cylinder 13 in an axial direction view of the crankshaft 16.

According to this configuration, space between the respective cylinder axes 31*b*, 41*b* of the front cylinder 12 and the rear cylinder 13 in the axial direction view of the crankshaft 16 can be effectively utilized.

Moreover, as the driving shaft rotation detecting sensor 165 is overlapped with the front cylinder 12 in the axial direction view of the crankshaft 16, the driving shaft rotation detecting sensor 165 can be arranged close to the front cylinder 12 and the driving shaft rotation detecting sensor 165 can be compactly arranged in the internal combustion engine 10.

Figure 3:
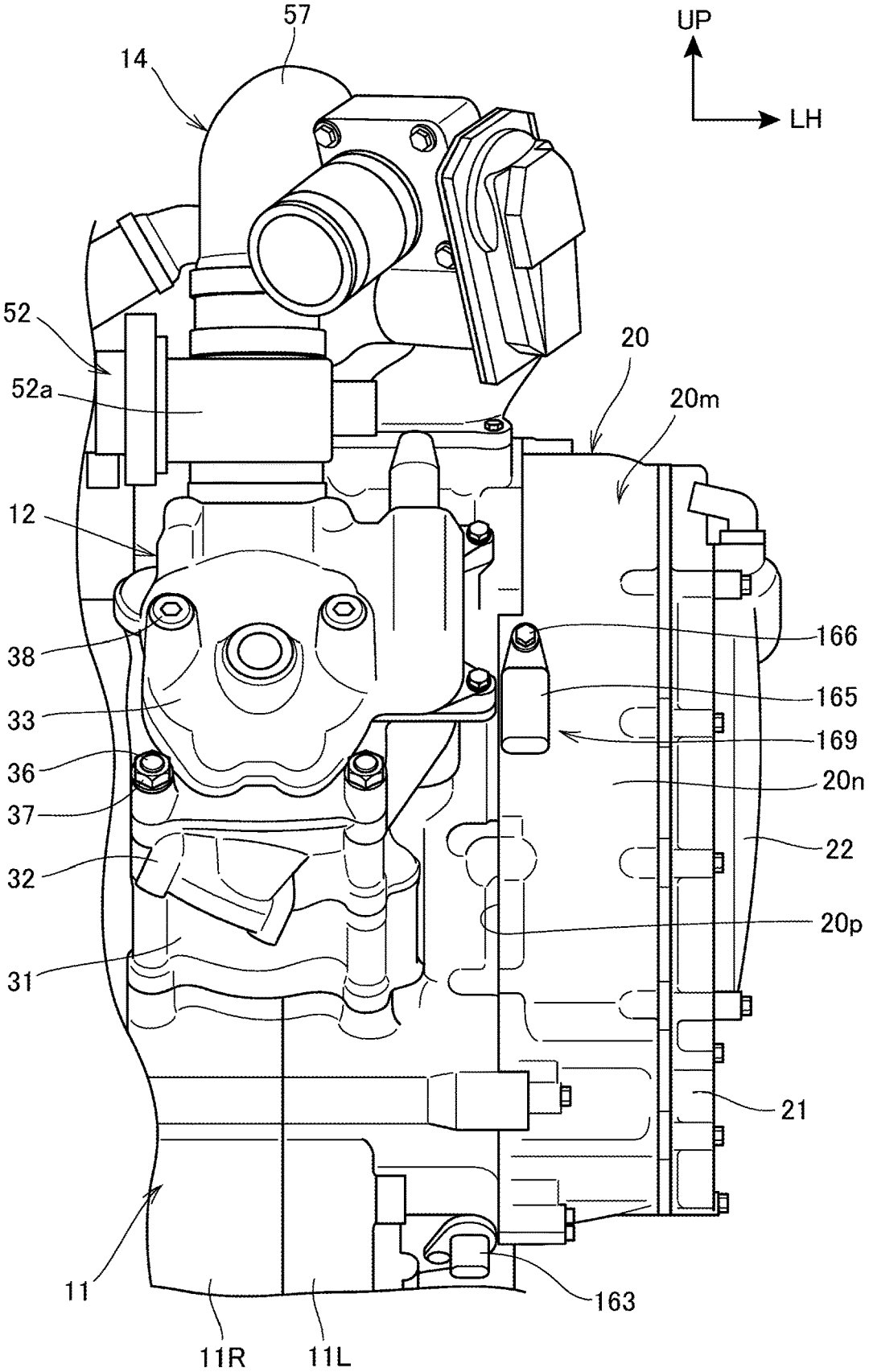
FIG. 3 is a front view of the internal combustion engine showing a driving shaft rotation detecting sensor that senses a number of revolutions of a driving shaft.

FIG. 3 is a front view showing the internal combustion engine 10 for showing the driving shaft rotation detecting sensor 165 that senses the number of revolutions of the driving shaft 63.

The crankcase 11 includes a left crankcase 11L and a right crankcase 11R respectively divided in the vehicle width direction.

The ACG cover 20 is attached to a side of the left crankcase 11L. The driving shaft rotation detecting sensor 165 that senses the number of revolutions of the driving shaft 63 (see FIG. 2) is attached, by a bolt 166, to a peripheral wall 20*m* of the ACG cover 20, detailedly to the back 20*n* inclined downward toward the rear of the peripheral wall 20*m*.

The driving shaft rotation detecting sensor 165 is arranged beside a mating face 20*p* provided to the ACG cover 20 so as to mate with the left crankcase 11L and the front cylinder 12 is located inside the driving shaft rotation detecting sensor 165 in the vehicle width direction.

As described above, as the driving shaft rotation detecting sensor 165 protruded from the ACG cover 20 is arranged beside the front cylinder 12, the driving shaft rotation detecting sensor 165 can be compactly arranged and the driving shaft rotation detecting sensor 165 can be mostly prevented from interfering with accessories of the internal combustion engine 10 and structure around the internal combustion engine 10.

Heretofore, the number of revolutions of the camshaft was sensed by a sensor provided to the cylinder head or the head cover in the vicinity of the camshaft, however, layout of the sensor in the cylinder head or the head cover had a constraint.

In the meantime, in this embodiment, as the camshaft 102 and the driving shaft 63 have the same number of revolutions, the number of revolutions of the camshaft 102 can be detected by sensing the number of revolutions of the driving shaft 63 by the driving shaft rotation detecting sensor 165.

As relatively large space exists on the back 20*n* of the ACG cover 20 in the internal combustion engine 10, it is suitable to arrange the driving shaft rotation detecting sensor 165.

Figure 4:
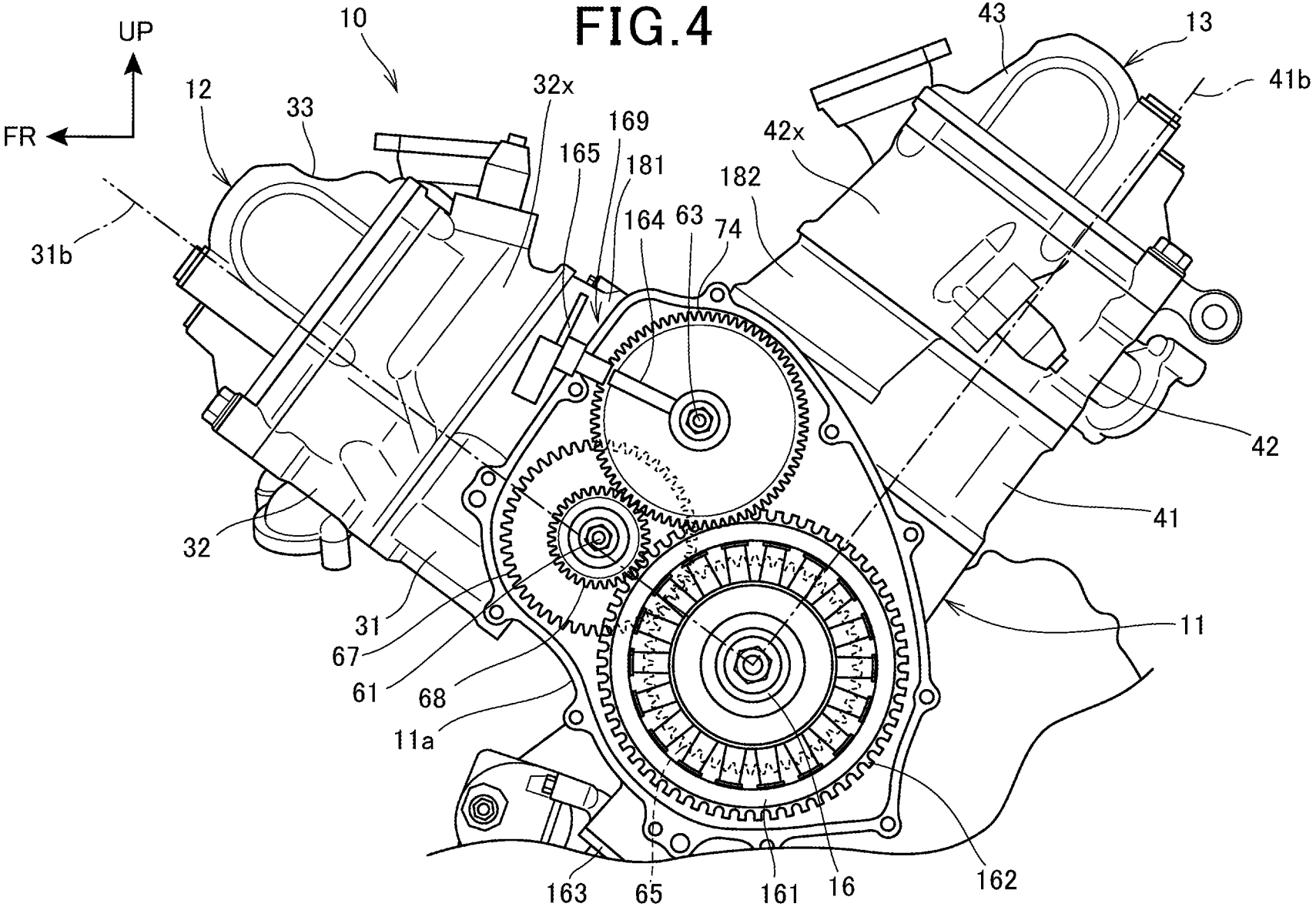
FIG. 4 is a left side view showing a state in which an ACG cover is detached from a crankcase.

FIG. 4 is a left side view showing a state in which the ACG cover 20 is detached from the crankcase 11.

An AC generator 161 and a rotating disc 162 arranged inside the AC generator 161 in the vehicle width direction are attached to an end of the crankshaft 16. The rotating disc 162 has plural protrusions arranged at a predetermined interval on an outer peripheral edge. A crankshaft rotation detecting sensor 163 that senses a number of revolutions of the rotating disc 162 (that is, the number of revolutions of the crankshaft 16) is arranged close to the protrusions of the rotating disc 162. The crankshaft rotation detecting sensor 163 is attached in such a manner that the crankshaft rotation detecting sensor 163 pierces a toroidal peripheral wall 11*a* provided to the crankcase 11 so as to attach the ACG cover 20 (see FIG. 3).

In a side view, a rotation sensed body 164 is attached to the driving shaft 63 arranged on the upside of the crankshaft 16. Besides, the driving shaft rotation detecting sensor 165 that senses rotation of the rotation sensed body 164 (that is, that senses the number of revolutions of the driving shaft 63) is attached to the peripheral wall 20*m* (see FIG. 3) of the ACG cover 20 attached to the peripheral wall 11*a* in such a manner that the driving shaft rotation detecting sensor 165 pierces the peripheral wall 20*m*.

The rotation sensed body 164 is a plate linearly extended outside in a radial direction from the driving shaft 63. A shape of the rotation sensed body 164 is not limited to a plate type, the rotation sensed body 164 may be also rodlike, fan-shaped, disclike or a shape forming a part of a disc, and in short, the shape of the rotation sensed body 164 has only to be a shape in which the rotation sensed body 164 is integrally rotated with the driving shaft 63 and in which at least one turn can be sensed by the driving shaft rotation detecting sensor 165 while the driving shaft 63 is rotated once.

The rotation sensed body 164 and the driving shaft rotation detecting sensor 165 configure a sensing system 169.

As the driving shaft 63 is rotated by the same number of revolutions as the camshaft 102 (see FIG. 2), the driving shaft rotation detecting sensor 165 senses the number of revolutions of the camshaft 102 in the end.

The driving shaft rotation detecting sensor 165 is arranged between the cylinder axis 31*b* of the front cylinder 12 and the cylinder axis 41*b* of the rear cylinder 13 in the side view. Besides, the driving shaft rotation detecting sensor 165 is overlapped with the front cylinder 12 in the side view. As described above, as the driving shaft rotation detecting sensor 165 is arranged inside contours of the front cylinder 12 and the rear cylinder 13 in the side view, the internal combustion engine 10 can be miniaturized and compacted.

Figure 5:
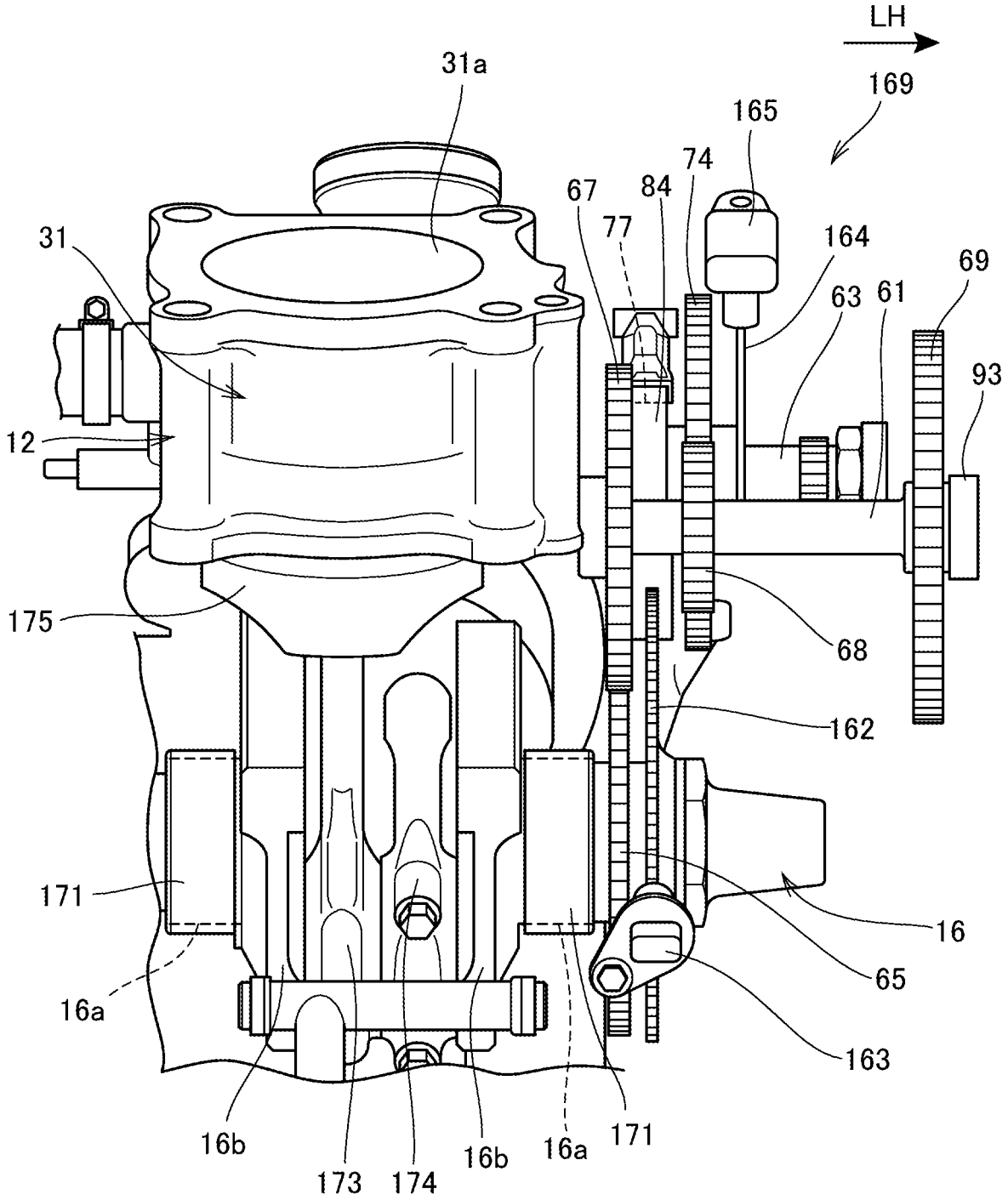
FIG. 5 is a front view showing a vehicle in a state in which a part of components of the internal combustion engine is detached.

FIG. 5 is a front view showing the vehicle in such a state that a part of components of the internal combustion engine 10 is detached.

The crankshaft 16 is provided with a pair of crank journals 16*a* supported by the crankcase 11 (see FIG. 5) via a pair of bearings 171, a pair of weights 16*b* adjacent to the crank journals 16*a* and a crankpin (not shown) that couples the pair of weights 16*b*. Respective one ends of a connecting rod 173 on the side of the front cylinder 12 and a connecting rod 174 on the side of the rear cylinder 13 (see FIG. 4) are swingably coupled to the crankpin. A piston 175 is coupled to each other end of the connecting rods 173, 174 via each piston pin (not shown). The piston 175 is respectively movably inserted into the cylinder bore 31*a* (see FIG. 2) of the front cylinder 12 and the cylinder bore 41*a* (see FIG. 2) of the rear cylinder 13 (see FIG. 2).

The main driving gear 65 is arranged between the rotating disc 162 and the bearing 171 on the crankshaft 16.

The intermediate shaft 61 is protruded outside the crankshaft 16 in the vehicle width direction. An end of the intermediate shaft 61 is supported by the side cover 21 (see FIG. 4) via a bearing 93.

The first intermediate gear 67 of the intermediate shaft 61 is arranged in the same position in the vehicle width direction in such a manner that the first intermediate gear 67 is engaged with the main driving gear 65 of the crankshaft 16. The third intermediate gear 69 located outside the crankshaft 16 in the vehicle width direction is attached to the end of the intermediate shaft 61 and the second intermediate gear 68 is arranged close to the first intermediate gear 67 between the first intermediate gear 67 and the third intermediate gear 69 on the intermediate shaft 61.

Out of the first intermediate gear 67, the second intermediate gear 68 and the third intermediate gear 69, the second intermediate gear 68 has the smallest outer diameter and the third intermediate gear 69 has the largest outer diameter.

On the driving shaft 63, the first timing sprocket 76 (see FIG. 2) and the second timing sprocket 77 provided outside the first timing sprocket 76 in the vehicle width direction are arranged inside the sub-driving gear 74 in the vehicle width direction.

Besides, the rotation sensed body 164 is arranged close to the sub-driving gear 74 between the sub-driving gear 74 and the third intermediate gear 69 in the vehicle width direction.

As described above, as the third intermediate gear 69 is arranged on the outermost of the intermediate shaft 61 in the vehicle width direction and the second intermediate gear 68 is arranged close to the first intermediate gear 67, the camshaft driving mechanism 80 (see FIG. 2) and the valve driving mechanism 89 (see FIG. 2) can be arranged inside the supercharger driving mechanism 90 (see FIG. 2) in the vehicle width direction of the internal combustion engine 10 (see FIG. 2). As the camshaft driving mechanism 80 and the valve driving mechanism 89 respectively have a more number of parts than the supercharger driving mechanism 90, the internal combustion engine 10 can be effectively miniaturized by arranging the camshaft driving mechanism 80 and the valve driving mechanism 89 inside in the vehicle width direction of the internal combustion engine 10. Besides, as the supercharger driving mechanism 90 has a smaller number of parts, increase in size of the internal combustion engine 10 can be inhibited even if the supercharger driving mechanism 90 is arranged further outside in the vehicle width direction of the internal combustion engine 10.

As shown in FIGS. 2, 4 and 5, in sensing system layout structure of the internal combustion engine 10 provided with the sensing system 169 for sensing the rotation of the camshaft 102, the internal combustion engine 10 is provided with the driving shaft 63 as a shaft member rotated in synchronization with the camshaft 102, the sensing system 169 is provided with the driving shaft rotation detecting sensor 165 as a sensor body arranged opposite to rotated portions on the side of the driving shaft 63, and the rotation of the driving shaft 63 is sensed by the driving shaft rotation detecting sensor 165.

According to this configuration, the sensing system 169 is not required to be arranged in vicinity of the camshaft 102 and a degree of freedom in laying out the sensing system 169 can be increased.

Besides, as shown in FIGS. 4 and 5, the rotation sensed body 164 as a sensed member sensed by the driving shaft rotation detecting sensor 165 is attached to the driving shaft 63.

According to this configuration, a function except detection can be given to the driving shaft 63 by using the rotation sensed body 164. Moreover, respective degrees of freedom in design of the driving shaft 63 and the rotation sensed body 164 can be increased by separately providing the driving shaft 63 and the rotation sensed body 164, and the driving shaft 63 and the rotation sensed body 164 can be made a simple shape.

The above-mentioned embodiment just discloses one aspect of the present invention, and modifications and applications may be arbitrarily made in a scope not deviating from the spirit of the present invention.

The present invention is not limited to the case that the present invention is applied to the internal combustion engine of the motorcycle and the present invention can be also applied to an internal combustion engine of a vehicle except the motorcycle or an internal combustion engine used for things except a vehicle.

REFERENCE SIGNS LIST

10 . . . Internal combustion engine
12 . . . Front cylinder (One-side cylinder)
13 . . . Rear cylinder (Other-side cylinder)
16 . . . Crankshaft
31*b*, 41*b* . . . Cylinder axis
63 . . . Driving shaft (Shaft member)
102 . . . Camshaft
164 . . . Rotation sensed body (Sensed member)
165 . . . Driving shaft rotation detecting sensor (Sensor body)
169 . . . Sensing system

The invention claimed is:

1. A sensing system layout structure of an internal combustion engine comprising a sensing system for sensing rotation of a camshaft, wherein the internal combustion engine includes: a crankcase, and a pair of cylinders that extends diagonally upward from an upper portion of the crankcase, a camshaft is rotatably supported on each of a cylinder head of the pair of cylinders, a driving shaft is rotatably supported by the crankcase to rotate in synchronization with the camshaft, the sensing system includes a sensor arranged opposite to a rotated portion on a side of the driving shaft and rotation of the driving shaft is sensed by the sensor, a cover that is separately provided with the crankcase and the pair of cylinders is attached to a side of the crankcase and the sensor is attached to a peripheral wall of the cover, and a sensed body sensed by the sensor is attached to the driving shaft so as to extend outside in a radial direction from the driving shaft, extend toward a peripheral wall of the cover, and integrally rotate with the driving shaft.

2. The sensing system layout structured of the internal combustion engine according to claim 1, wherein the driving shaft is rotated at equal velocity of the camshaft.

3. The sensing system layout structured of the internal combustion engine according to claim 1, wherein the internal combustion engine is a V type including a one-side cylinder and an other-side cylinder, a V shape of the internal combustion engine being formed by the one-side cylinder and the other-side cylinder, and the sensor is arranged between respective cylinder axes of the one-side cylinder and the other-side cylinder in an axial direction view of the crankshaft.

4. The sensing system layout structure of the internal combustion engine according to claim 3, wherein the sensor is arranged in such a manner that the sensor is overlapped with the one-side cylinder in the axial direction view of the crankshaft.

5. The sensing system layout structure of the internal combustion engine according to claim 2, wherein the internal combustion engine is a V type including a one-side cylinder and an other-side cylinder, a V shape of the internal combustion engine being formed by the one-side cylinder and the other-side cylinder, and the sensor is arranged between respective cylinder axes of the one-side cylinder and the other-side cylinder in an axial direction view of the crankshaft.

6. The sensing system layout structure of the internal combustion engine according to claim 1, wherein the peripheral wall of the cover includes an inclined wall inclined with respect to a horizontal direction orthogonal to the driving shaft, and the sensor is attached to the inclined wall.

* * * * *